US010619914B2

(12) United States Patent
Pinheiro et al.

(10) Patent No.: US 10,619,914 B2
(45) Date of Patent: Apr. 14, 2020

(54) TELESCOPING FIXTURE APPLIED TO A REFRIGERATOR DOOR OR THE LIKE

(71) Applicant: ELECTROLUX DO BRASIL S.A., Curitiba-PR (BR)

(72) Inventors: Fernando Martins Fernandes Pinheiro, Curitiba (BR); Fernando Vieira Sobezak, Curitiba (BR); Gabriel Gemael Polycarpo Lied, Curitiba (BR); Renato DeAraújo Jabur Bondiolli, Curitiba (BR); Rodrigo Telles Wolff, Curitiba (BR)

(73) Assignee: Electrolux Do Brasil S.A., Curitiba-PR (BR)

( * ) Notice: Subject to any disclaimer, the term of this patent is extended or adjusted under 35 U.S.C. 154(b) by 70 days.

(21) Appl. No.: 15/503,308

(22) PCT Filed: Jul. 17, 2015

(86) PCT No.: PCT/BR2015/050094
§ 371 (c)(1),
(2) Date: Feb. 10, 2017

(87) PCT Pub. No.: WO2016/023091
PCT Pub. Date: Feb. 18, 2016

(65) Prior Publication Data

US 2018/0216874 A1 Aug. 2, 2018

(30) Foreign Application Priority Data

Aug. 14, 2014 (BR) ..... 1020140201602

(51) Int. Cl.
*F25D 25/02* (2006.01)
*F25D 23/04* (2006.01)
(Continued)

(52) U.S. Cl.
CPC ..... *F25D 25/024* (2013.01); *A47B 45/00* (2013.01); *A47B 96/025* (2013.01);
(Continued)

(58) Field of Classification Search
CPC ..... F25D 25/024; F25D 23/028; F25D 2325/021; F25D 23/04; A47B 45/00; A47B 96/025; A47F 5/0846
See application file for complete search history.

(56) References Cited

U.S. PATENT DOCUMENTS 1,851,965 A * 3/1932 Bartholomae ..... A47B 96/025 108/137
2,144,534 A * 1/1939 Hedquist ..... A47B 45/00 211/88.01

(Continued)

FOREIGN PATENT DOCUMENTS

| | | |
|---|---|---|
| CN | 2903840 | 5/2007 |
| CN | 201555417 | 8/2010 |
| CN | 203036991 | 7/2013 |

OTHER PUBLICATIONS

International Search Report and Written Opinion for International Application No. PCT/BR2015/050094, dated Aug. 14, 2014, 10 pages.

(Continued)

*Primary Examiner* — Ko H Chan
(74) *Attorney, Agent, or Firm* — RatnerPrestia

(57) ABSTRACT

A fixture in the form of a shelf that can be mounted to a support bar secured to the inner face of a refrigerator door. The shelf is telescopic and has at least two parts, a base and a platform, both being slidable upon each other and slidable along the support bar. The base and the platform have mounting means on the support bar and route-limited fitting and sliding means therebetween. The fixture allows for an increase or reduction in space of the telescoping shelf for (Continued)

better arranged storage of beverage cans or the like, in order to ensure versatility and safety to the arrangement of cited products.

11 Claims, 4 Drawing Sheets

(51) Int. Cl.
*A47B 45/00* (2006.01)
*A47F 5/08* (2006.01)
*A47B 96/02* (2006.01)
*F25D 23/02* (2006.01)

(52) U.S. Cl.
CPC ..... *A47F 5/0846* (2013.01); *F25D 23/028* (2013.01); *F25D 23/04* (2013.01); *F25D 2325/021* (2013.01)

(56) References Cited

U.S. PATENT DOCUMENTS 2,899,011 A * 8/1959 Babits ..... E06C 7/165 182/120
3,912,291 A * 10/1975 Frisch ..... B62B 3/1428 211/135
4,036,369 A * 7/1977 Eisenberg ..... A47B 45/00 108/102
4,155,312 A * 5/1979 Thorkildson ..... A47B 45/00 108/102
4,564,118 A * 1/1986 Heyer ..... F25D 25/021 220/8
4,685,574 A * 8/1987 Young ..... A47F 1/12 211/184
5,096,272 A * 3/1992 Belokin, Jr. ..... A47F 3/06 211/90.01
5,806,690 A * 9/1998 Johnson ..... A47F 1/126 211/175
5,967,478 A * 10/1999 Tynes ..... A47B 45/00 248/208
6,412,601 B1 * 7/2002 Schmidt ..... E06C 7/14 182/120
6,655,538 B2 12/2003 Saulnier-Matteini
7,571,821 B2 * 8/2009 Noble Colin ..... A47F 5/12 211/90.03
7,992,728 B2 * 8/2011 Burgess ..... A47F 5/0056 211/126.15
9,386,865 B2 * 7/2016 Bally ..... A47F 3/14
9,400,132 B2 * 7/2016 Shrader ..... F25D 23/02
9,874,393 B2 * 1/2018 Rackley ..... F25D 23/028
10,244,873 B2 * 4/2019 Brenner ..... A47F 3/0426
10,264,880 B1 * 4/2019 Koutny ..... A47C 13/00
2006/0186065 A1 8/2006 Ciesick
2010/0096345 A1 4/2010 Crawbuck

OTHER PUBLICATIONS

English translation of the Chinese Office Action for Chinese Application No. 201580042438.9, dated Dec. 11, 2018, 6 pages.

* cited by examiner

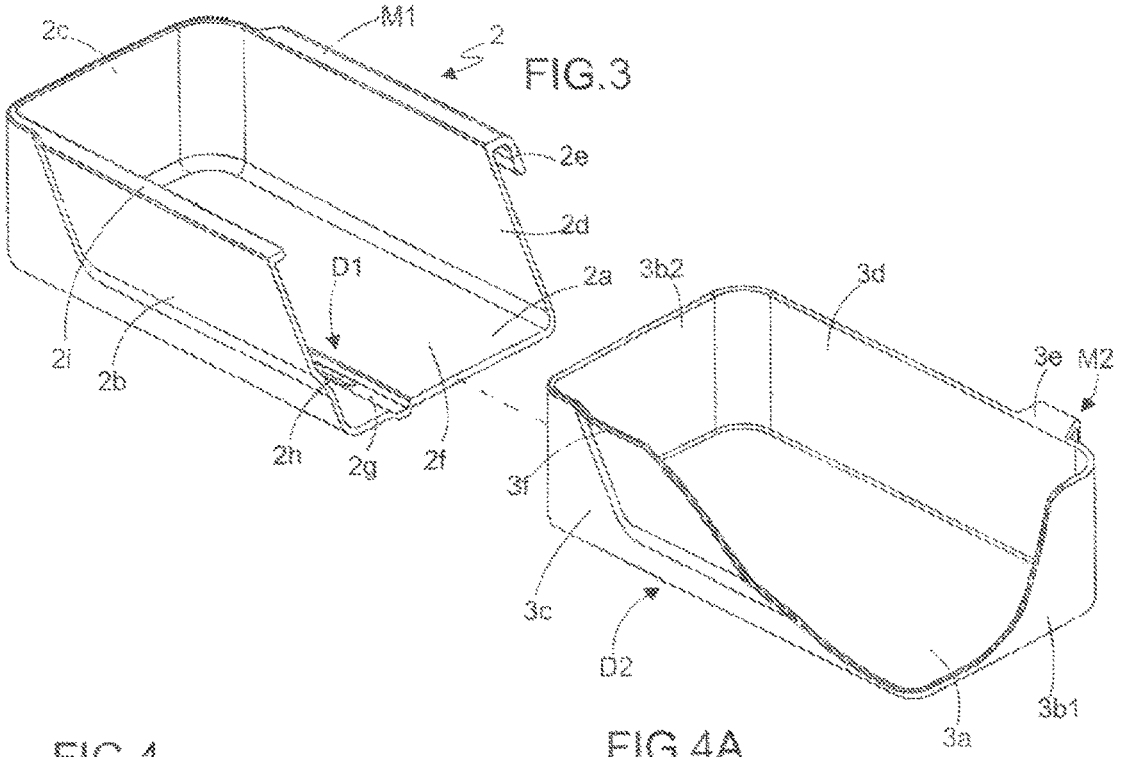
FIG.3
FIG.4
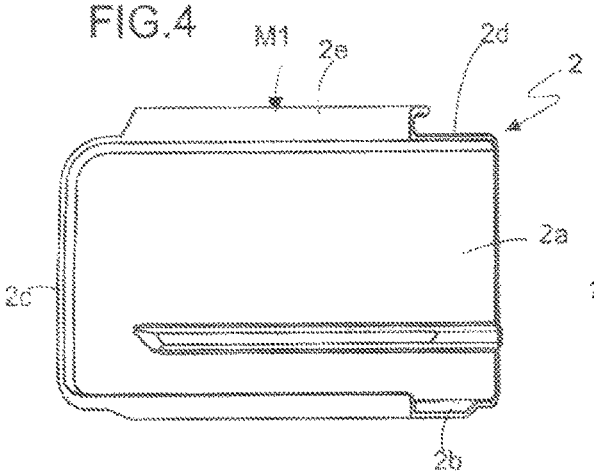
FIG.4A
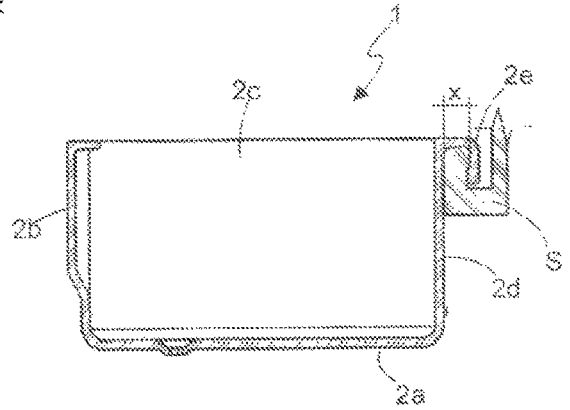
FIG.5
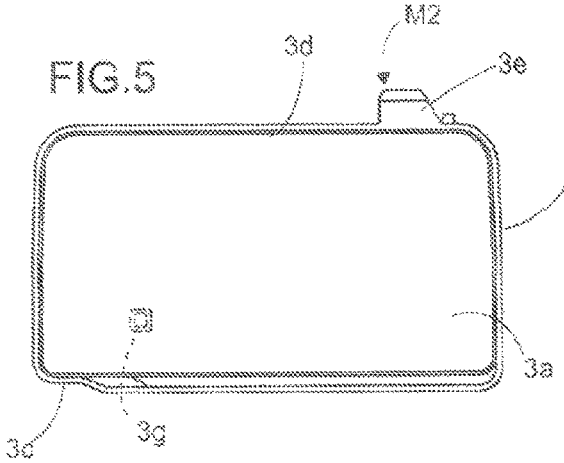
FIG.5A
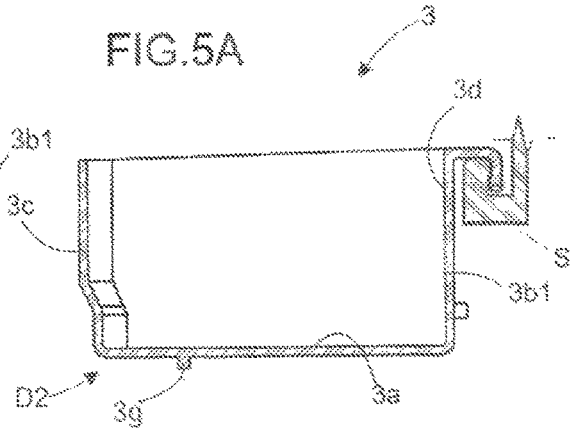

Cutaway A.A

TELESCOPING FIXTURE APPLIED TO A REFRIGERATOR DOOR OR THE LIKE

This application is a U.S. National Phase application of PCT International Application No. PCT/BR2015/050094, filed Jul. 17, 2015, which claims the benefit of BR 10 2014 0201602, filed Aug. 14, 2014, both of which are incorporated by reference herein.

FIELD OF APPLICATION

The present invention relates to a telescoping fixture, more precisely in the form of a shelf, which can be mounted to a bar attached to the inner face of a refrigerator door; said fixture being formed of at least two engageable parts longitudinally slidable upon each other, which enables an increase or reduction in the shelf space for better arranged storage of beverage cans or the like, in order to ensure versatility and safety to the arrangement of cited products.

BACKGROUND ART

Much progress has been made in recent years in the field of domestic refrigerators, such as a reduction in the consumption of energy, sustainable solutions, more attractive and differentiated designs and of course interactivity, are some elements that currently weigh the choice of this indispensable appliance.

More related to the object of the present invention, it is known that conventional refrigerator doors are configured by narrow shelves or trays consisting of a single piece having front and side walls and eventually a rear wall, forming a receptacle or tray which is secured to the inner face through attachments or small hooks.

In general, these conventional shelves or trays do not have any adjustment means to suit their needs or stored volumes, resulting in an unsuitable use because upon receiving a smaller number of items they may allow for the items to move, tip over or fall from the same when one opens and closes the door.

More recently, refrigerator manufacturers have been generally seeking to promote improvements in the space of the inner face of the door and to that end, compartments or shelves are already known which have been specially designed to certain items, such as for eggs, spices, beverage cans, bottles of at least 1 or 2 liters, among others, which improvements are designed to meet the user's needs and provides more available options when purchasing the appliance.

The applicant itself already owns some patent documents and industrial designs especially dedicated to shelf or tray designs applied to in the inner faces of refrigerator doors. For example, document PI 1001546-9 refers to a bar-shaped structure to serve as a support for accessories, such as several shelves, which bar is applied to a refrigerator door or the like. Said bar design is also used as a support to the present telescopic fixture, as discussed hereinbelow.

Analysis of the State of the Art

In searches in specialized data bases a few documents were found to refer to telescopic shelves applied to gondolas and other user access points.

Examples of shelves having space adjusting members can be seen in documents U.S. Pat. No. 6,655,538 (Soulnier), US 2010096345 (CRAWBUCK et al) and US 2006186065 (Ciesick). Although they belong to the same field of application, none of the cited documents anticipates the features of the present invention.

Chinese document CN 203036991 (Midea) discloses a refrigerator door tray having inner space adjusting means comprised of partition boards that are manually slidable along the inner side of the tray, which provides multiple slots to stabilize the boards. Therefore, the space can be either reduced or increased and said boards serve as a guard to items arranged on the tray, especially when a small amount of items is present.

Said shelf design having an adjusting feature of the Chinese document teaches away from the design presented herein not only in terms of construction complexity but also in terms of manufacture costs, molds used, mode of assembly and operation.

The search also leads to the conclusion that the object of the present invention is both novel and inventive over conventional designs.

BRIEF DESCRIPTION OF THE INVENTION

To provide improvements over the art, the Applicant has developed the present telescoping fixture, more precisely in the form of a shelf, which can be mounted to a bar secured to the inner face of a refrigerator door.

The inventive telescoping shelf is comprised of at least two parts that are slidable upon each other, wherein one of the parts is designated as base and the other as sliding platform, which sliding movement takes place along the longitudinal axis of the shelf.

Thus, said sliding movement of the platform inside the shelf base provides for the possibility of increasing or reducing storage space. The base part is mounted to one of the support bars, as anticipated by document PI 1001546-9 or the like, which support is firmly installed to in the inner face of the refrigerator door, thus providing the consumers with a range of new layouts, in accordance with the users' needs.

The telescoping shelf can be used in any of the refrigerator bars, in accordance with the arrangement established by the consumer as a function of the intended space.

The main advantages of the new telescoping shelf over the conventional models are as follows:

(i) more flexibility in the arrangement of the refrigerator door inner face, as it can be composed with other shelves for other items;

(ii) it enables an increased or reduced shelf space providing safe storage of the items arranged therein;

(iii) it is extremely easy to be prepared and assembled by the user, and can be removed to be cleaned.

DESCRIPTION OF THE FIGURES

To complement the present description so as to obtain a better understanding of the features of the present invention and according to a practical preferred embodiment thereof, a set of drawings is attached to the description where, in an exemplary and non-limitative manner, the operation thereof is depicted:

FIGS. 1 and 2 disclose the manner by which the telescoping shelf is assembled, wherein FIG. 1 shows the shelf installed to a refrigerator door having support bars and FIG. 2 illustrates an enlarged view of the same shelf duly mounted to the support bar;

FIG. 3 shows an exploded perspective view, wherein the part designated as platform is illustrated in a partial cut;

FIGS. 4 and 4A are top views and side cut views of the part designated as base;

FIGS. 5 and 5A are top views and side cut views of the part designated as platform;

DESCRIPTION OF THE ADDITION

According to the related figures, the present invention is directed to a "TELESCOPING FIXTURE APPLIED TO A REFRIGERATOR DOOR OR THE LIKE", more precisely, it relates to a fixture in the form of a shelf (1) that can be mounted to a support bar (S) or the like secured to the inner face (F) of the door (P) of a refrigerator (R).

According to the present invention, the shelf (1) is telescopic and to that end it comprises at least two parts, namely, one base (2) and one platform (3), both being slidable upon each other and slidable along the support bar (S), since both the base (2) and the platform (3) have mounting means (M1) and (M2) onto the support bar (S) and route-limited (w) fitting and sliding means (D1) and (D2) therebetween.

The base (2) comprises a receiving compartment formed by a bottom (2*a*) from where the front (2*b*), side (2*c*) and rear (2*d*) walls project, and from the upper edge thereof an inverted L-shaped short wall (2*e*) is projected, which has a especially sized gap (x) that configures the mounting means (M1) with regard to the support bar (S). The side that is opposite to wall (2*c*) is completely open (2*f*). The bottom (2*a*) has a longitudinal recess (2*g*) provided with a tearing (2*h*). The upper edge of wall (2*b*) is provided with a short orthogonal wall (2*i*).

The slidable platform (3), in turn, comprises another receiving compartment formed by a bottom (3*a*), opposed side walls (3*b*1) and (3*b*2), front (3*c*) and rear walls (3*d*) having the same height as base (2) wall (2*d*) and having a short section shaped as an inverted "L" (3*e*) having an especially sized gap (x) that configures the mounting means (M2) in relation to the support bar (S). Wall (3*c*) is slightly shorter than the rear wall (3*d*) such that the upper edge (3*f*) thereof is retained at a position below the orthogonal side (2*i*) of part (2). The outer face of the bottom (3*a*) includes a cursor feature (3*g*) having suitable dimensions to be positioned into and to slide along the tearing (2*h*) of the recess (2*g*) of the base (2).

Figure 1:
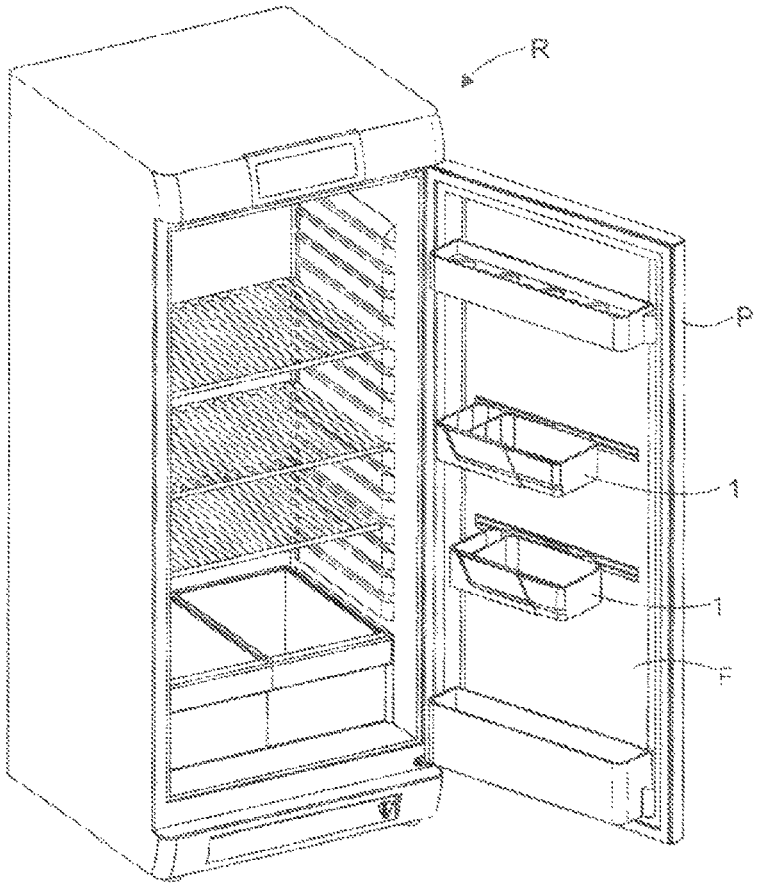
Figure 2:
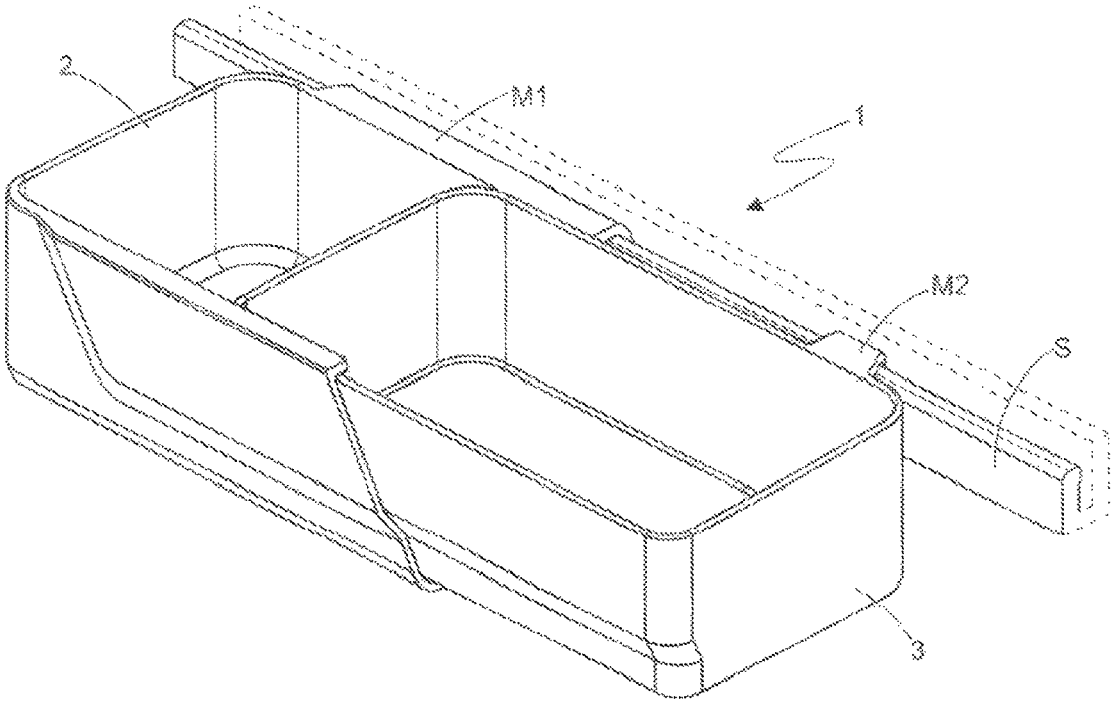
Figure 6:
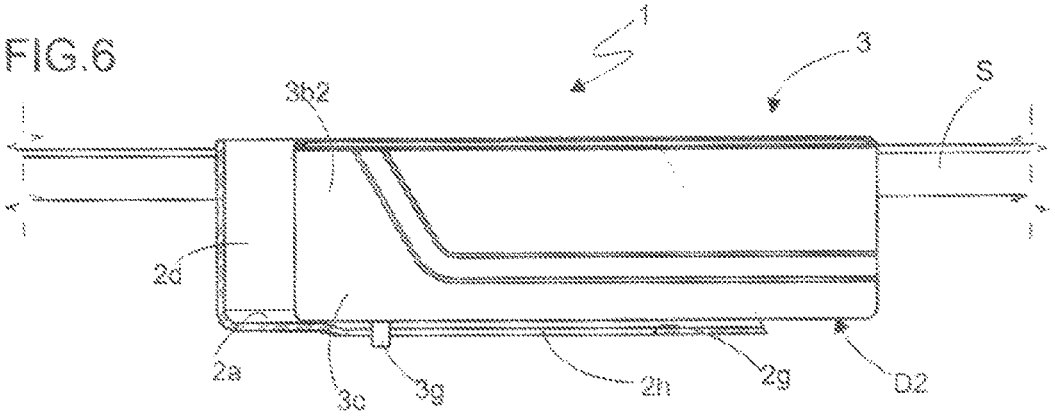
FIG. 6 shows a side view of the telescoping shelf showing a cutaway of the base piece in order to enable one to see the platform within it and the respective sliding assembly.
Figure 6A:
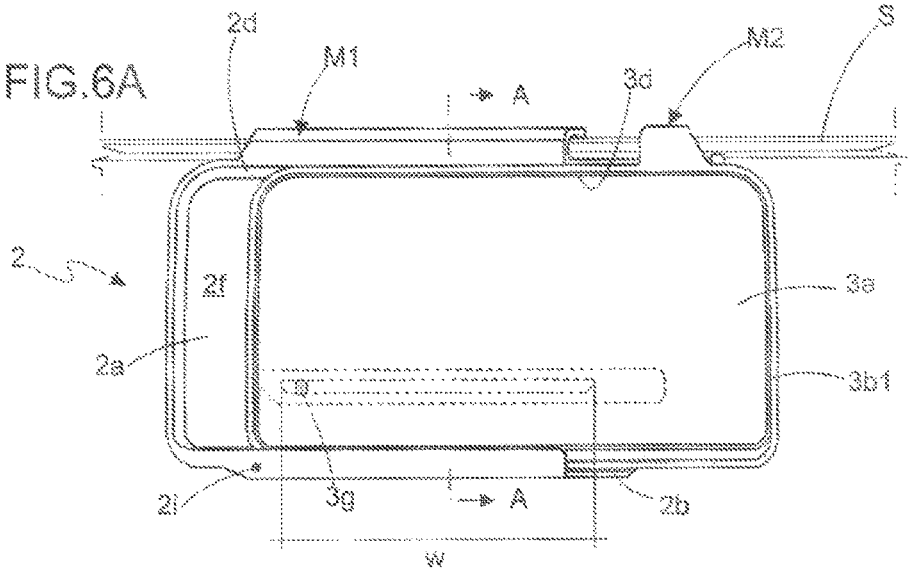
FIG. 6A is a top view of the mounted telescoping shelf.
Figure 6B:
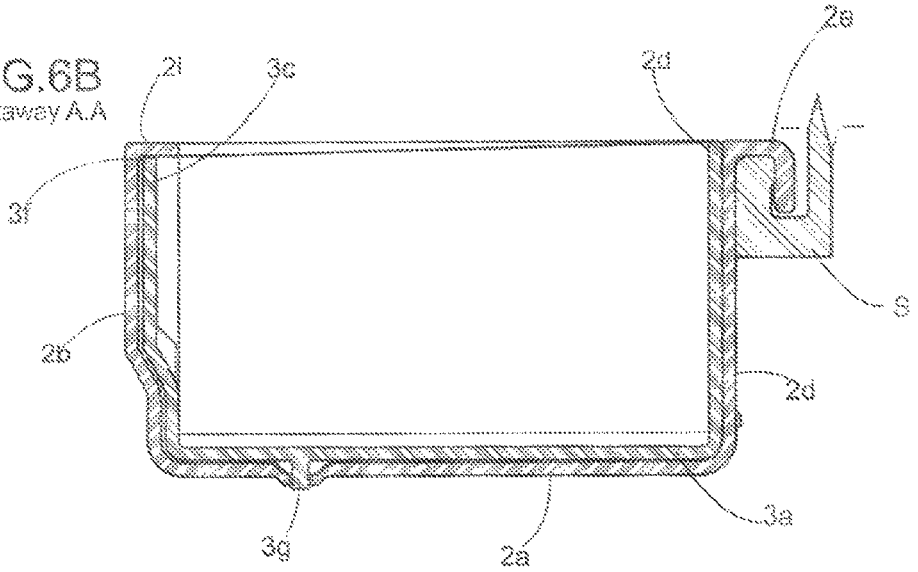
FIG. 6B illustrates a cross-section depicted in the previous figure.
Figure 7:
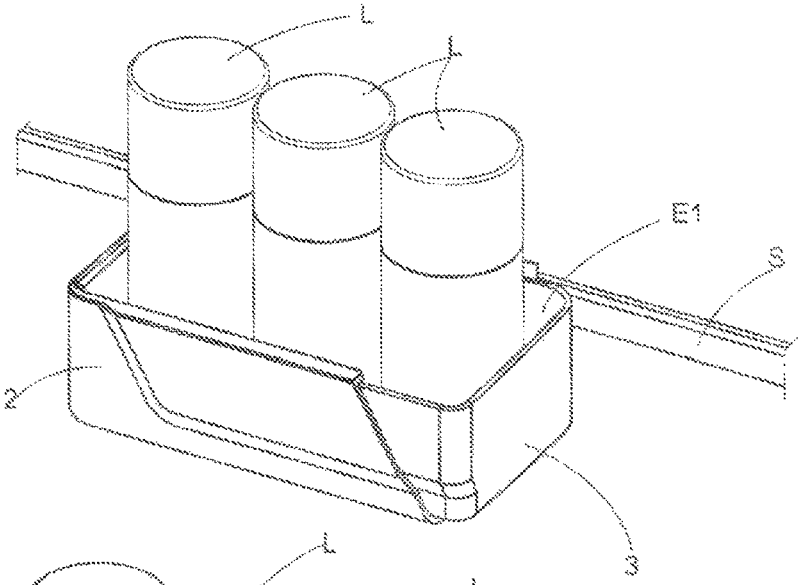
FIGS. 7, 8 and 9 illustrate, by means of perspective views, dimensional variations enabled by the telescopic sliding of the instant shelf.
Figure 8:
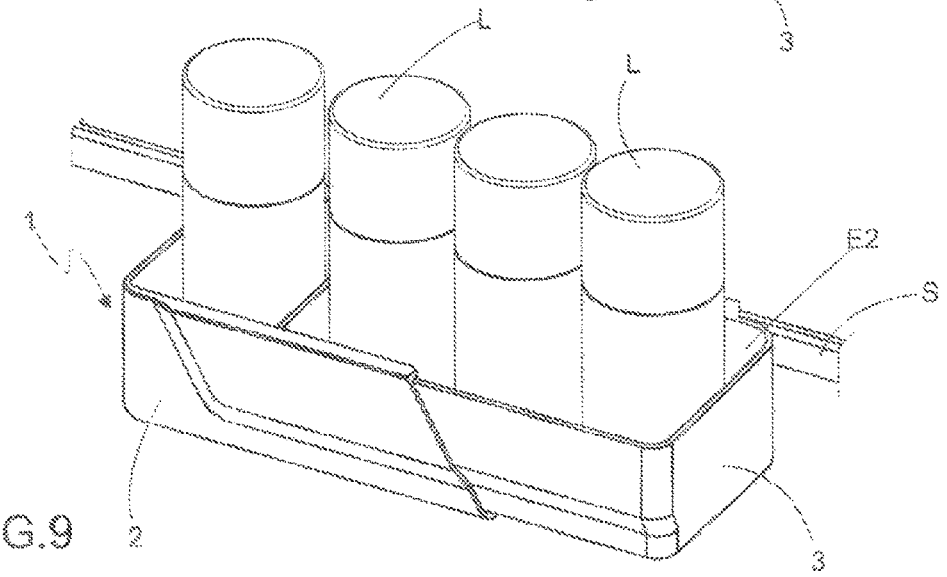
Figure 9:
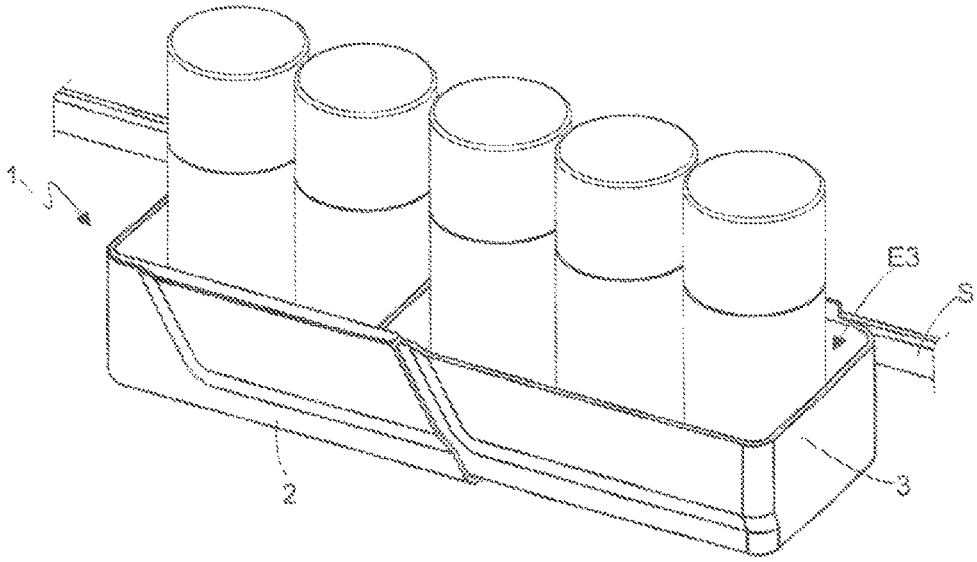

Having described the base (2) and platform (3) parts of the telescoping shelf (1), wherein the same are duly mounted to the support bar (S) and the cursor feature (3*g*) of the platform (3) is fitted to the tearing (2*h*) of the base (2), the user only needs to slide said platform (3) longitudinally to one of two sides inside the base (2), inside the route (w) limited by the size of the tearing, so as to reduce, or to cause the inner space of the shelf (1) to be reduced (E1) or increased (E2)/(E3) in accordance with the user's needs (FIGS. 7, 8 and 9).

When practicing the present invention, modifications can be introduced to certain details of the construction and shape, without departing from the basic principles of the set of claims, it being understood that the terminology used is not intended to be limitative.

The invention claimed is:

1. A telescoping fixture comprising:

a support bar configured to be secured to an inner face of a refrigerator door; and a shelf configured to be mounted to the support bar, the shelf comprising a base and a platform, the base being slidably connected to the support bar by a first inverted L-shaped base wall projecting from the base rear wall and sized to engage the support bar, the platform being slidably connected to the support bar by a second inverted L-shaped platform wall projecting from a platform rear wall and sized to engage the support bar, and the platform being slidably connected to the base by a route-limited fitting and sliding means, wherein when the shelf is fully attached to the support bar, the base is slidable relative to the support bar, and the platform is slidable relative to the base;

wherein the base comprises:

a receiving compartment formed of the base bottom from which a base front wall, the base side wall and a base rear wall project; and an opening extending from the base front wall to the base rear wall at the open side opposite the base side wall;

a lengthwise recess provided in the base bottom and extending in a direction extending from the base side wall to the open side, the lengthwise recess having a gap therein; and wherein the platform comprises:

a receiving compartment formed of a platform bottom, a first platform side wall, a second platform side wall opposite the first platform side wall, a platform front wall, and the platform rear wall; and the platform bottom includes a cursor feature configured and dimensioned to be positioned in and to slide along the gap, the cursor and the gap together forming the route-limited fitting and sliding means.

2. The telescoping fixture of claim 1, wherein the platform rear wall terminates at a respective upper edge that is at a level with a respective upper edge of the base rear wall.

3. The telescoping fixture of claim 1, wherein the base further comprises a base top wall extending from an upper end of the base front wall towards the base rear wall.

4. The telescoping fixture of claim 3, wherein the platform front wall terminates at a respective upper edge that is located below the base top wall.

5. The telescoping fixture of claim 1, wherein the base is movable relative to the platform along a distance defined by a travel distance of the cursor within the gap.

6. A telescoping fixture comprising:

a support bar configured to be secured to an inner face of a refrigerator door;

a shelf configured to be mounted to the support bar, the shelf comprising a base and a platform;

the base comprising a base bottom from which a base front wall, a base side wall and a base rear wall project, an opening located between the base front wall and the base rear wall at an open side opposite the base side wall, an inverted L-shaped base wall projecting from the base rear wall and sized to partially surround an upper portion of the support bar for slidable movement thereon, and a lengthwise recess provided in the base bottom and extending in a direction extending from the base side wall to the open side, the lengthwise recess having a gap therein; and the platform comprising a platform bottom, a first platform side wall, a second platform side wall opposite the first platform side wall, a platform front wall, and a platform rear wall, an inverted L-shaped platform wall projecting from the platform rear wall and sized to partially surround the upper portion of the support bar for slidable movement thereon, and a cursor configured and dimensioned to be positioned in and to slide along the gap between a first position at a first end of the gap and a second position at the second end of the gap.

7. The telescoping fixture of claim 6, wherein the platform rear wall comprises a respective upper edge that is at a level with a respective upper edge of the base rear wall.

8. The telescoping fixture of claim 7, wherein the base further comprises a base top wall extending from an upper end of the base front wall towards the base rear wall.

9. The telescoping fixture of claim 8, wherein the platform front wall comprises a respective upper edge that is located below the base top wall.

10. The telescoping fixture of claim 1, wherein the route-limited fitting and sliding means comprise a tab configured to prevent the platform from moving beyond a predetermined position relative to the base.

11. A refrigerator, comprising:

a casing;

a refrigerator door arranged within the casing for accessing an interior of the casing; and a telescoping fixture, comprising:

a support bar attached to an inner surface of the refrigerator door; and a shelf configured to be mounted to the support bar, the shelf comprising a base and a platform, wherein:

the base is slidably connected to the support bar by a first inverted L-shaped base wall projecting from a base rear wall and sized to engage the support bar, the platform is slidably connected to the support bar by a second inverted L-shaped platform wall projecting from a platform rear wall and sized to engage the support bar, when the shelf is mounted to the support bar, the base is slidable relative to the support bar, and the platform is slidable relative to the base wherein the base comprises:

a receiving compartment formed of the base bottom from which a base front wall, the base side wall and a base rear wall project; and an opening extending from the base front wall to the base rear wall at the open side opposite the base side wall;

a lengthwise recess provided in the base bottom and extending in a direction extending from the base side wall to the open side, the lengthwise recess having a gap therein; and wherein the platform comprises:

a receiving compartment formed of a platform bottom, a first platform side wall, a second platform side wall opposite the first platform side wall, a platform front wall, and the platform rear wall; and the platform bottom includes a cursor feature configured and dimensioned to be positioned in and to slide along the gap, the cursor and the gap together forming a route-limited fitting and sliding means.

* * * * *